US011649717B2

(12) United States Patent
Gooneratne et al.

(10) Patent No.: US 11,649,717 B2
(45) Date of Patent: May 16, 2023

(54) SYSTEMS AND METHODS FOR SENSING DOWNHOLE CEMENT SHEATH PARAMETERS

(71) Applicant: Saudi Arabian Oil Company, Dhahran (SA)

(72) Inventors: Chinthaka Pasan Gooneratne, Dhahran (SA); Bodong Li, Dhahran (SA); Timothy Eric Moellendick, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 471 days.

(21) Appl. No.: 16/133,225

(22) Filed: Sep. 17, 2018

(65) Prior Publication Data

US 2020/0088023 A1 Mar. 19, 2020

(51) Int. Cl.

| | |
|---|---|
| ***E21B 47/005*** | (2012.01) |
| ***E21B 47/06*** | (2012.01) |
| ***E21B 49/00*** | (2006.01) |
| ***E21B 47/13*** | (2012.01) |

(52) U.S. Cl.

CPC ..... *E21B 47/005* (2020.05); *E21B 47/06* (2013.01); *E21B 47/13* (2020.05); *E21B 49/006* (2013.01)

(58) Field of Classification Search

CPC ..... E21B 47/005; E21B 47/01; E21B 47/13; E21B 47/06; E21B 49/006

See application file for complete search history.

(56) References Cited

U.S. PATENT DOCUMENTS

| | | | |
|---|---|---|---|
| 4,319,345 | A | 3/1982 | Dennis |
| 4,594,691 | A | 6/1986 | Kimball et al. |
| 5,387,767 | A | 2/1995 | Aron et al. |
| 5,644,186 | A | 7/1997 | Birchak et al. |
| 6,053,245 | A | 4/2000 | Haberman |
| 6,125,935 | A | 10/2000 | Shahin, Jr. |
| 6,408,943 | B1 | 6/2002 | Schultz et al. |
| 6,633,236 | B2 | 10/2003 | Vinegar et al. |
| 6,693,554 | B2 | 2/2004 | Beique et al. |

(Continued)

FOREIGN PATENT DOCUMENTS

| | | |
|---|---|---|
| EP | 0552833 A1 | 7/1993 |
| EP | 0660136 A2 | 6/1995 |

(Continued)

OTHER PUBLICATIONS

International Search Report and Written Opinion for International Application No. PCT/US2019/050868 dated Nov. 29, 2019; pp. 1-15.

*Primary Examiner* — Isam A Alsomiri
*Assistant Examiner* — Abdallah Abulaban
(74) *Attorney, Agent, or Firm* — Bracewell LLP; Constance G. Rhebergen; Keith R. Derrington

(57) ABSTRACT

Wireless mobile devices are injected into a wellbore with a cement slurry, during the cementing of casing, to monitor and evaluate cement sheath parameters. Passive, wireless sensors are utilized to not only measure the elastic constitutive properties of the cement sheath such as compressive strength, but also parameters of the cement sheath environment, such as temperature, pressure, humidity, pH and gases present, to identify potential issues about the structural integrity of the cement sheath, and provide timely warnings to perform remedial actions.

20 Claims, 17 Drawing Sheets

(56) References Cited

U.S. PATENT DOCUMENTS 6,950,767 B2 9/2005 Yamashita et al.
6,978,832 B2 12/2005 Gardner et al.
6,987,463 B2 1/2006 Beique et al.
6,989,764 B2 1/2006 Thomeer et al.
7,036,363 B2 5/2006 Yogeswaren
7,158,049 B2 1/2007 Hoefel et al.
7,173,542 B2 2/2007 Beique et al.
7,219,730 B2 5/2007 Tilton et al.
7,424,403 B2 9/2008 Robinson et al.
7,450,053 B2 11/2008 Funk et al.
7,551,058 B1 6/2009 Johnson et al.
7,602,668 B2 10/2009 Liang et al.
7,639,563 B2 12/2009 Wu et al.
8,033,177 B2 10/2011 Keilman et al.
8,061,658 B2 11/2011 Bullesbach
8,316,936 B2 11/2012 Roddy et al.
8,378,840 B2 2/2013 Khan et al.
8,397,810 B2 3/2013 Verret et al.
8,434,354 B2 5/2013 Crow et al.
8,434,571 B2 5/2013 Kannan et al.
8,446,292 B2 5/2013 Layton
8,505,625 B2 8/2013 Ravi et al.
8,519,595 B2 8/2013 Hunter et al.
8,544,564 B2 10/2013 Moore et al.
8,547,789 B2 10/2013 Wu et al.
8,636,063 B2 1/2014 Ravi et al.
9,277,329 B2 3/2016 Schelling et al.
9,364,109 B2 * 6/2016 Paukovits ..... G01F 11/06
9,394,785 B2 7/2016 Goodwin et al.
9,404,360 B2 8/2016 Difoggio et al.
9,554,213 B2 1/2017 Miles et al.
9,822,631 B2 * 11/2017 Ravi ..... E21B 43/25
2002/0149500 A1 10/2002 Beique et al.
2003/0052185 A1 3/2003 Arian et al.
2008/0236814 A1 10/2008 Roddy
2010/0077863 A1 4/2010 Miyoshi et al.
2014/0111349 A1 4/2014 Roberson et al.
2014/0150548 A1 6/2014 Childers et al.
2014/0354443 A1 12/2014 Roberson et al.
2015/0035783 A1 * 2/2015 Brillant ..... G06F 3/04166 345/174
2015/0175869 A1 6/2015 Agapiou et al.
2015/0177198 A1 6/2015 Thierry et al.
2016/0040524 A1 2/2016 Ravi et al.
2016/0266086 A1 9/2016 Herzen et al.
2017/0122077 A1 * 5/2017 Shahri ..... G06F 30/20
2017/0204719 A1 7/2017 Babakhani
2018/0010438 A1 1/2018 Ravi et al.
2018/0369571 A1 * 12/2018 Landsberger ..... A61N 1/36039

FOREIGN PATENT DOCUMENTS

EP 0671547 A1 9/1995
WO 02059458 A2 8/2002
WO 2015103111 A1 7/2015
WO WO-2016004137 A1 * 1/2016 ..... B65G 5/00
WO 2016019247 A1 2/2016
WO 2016044070 A1 3/2016
WO 2016048267 A1 3/2016
WO 2016148683 A1 9/2016
WO 2016186653 A1 11/2016
WO 2017171723 A1 10/2017

* cited by examiner

SYSTEMS AND METHODS FOR SENSING DOWNHOLE CEMENT SHEATH PARAMETERS

BACKGROUND

1. Field

Embodiments of the present disclosure relate to systems and methods for wirelessly monitoring well conditions.

2. Description of Related Art

Oil and gas wells are high pressure vessels drilled thousands of feet into the ground to gain access to oil and gas reservoirs. The integrity of these wells come from the steel pipes called "casings" that are lowered and lined into the wellbore to support the sides of the wellbore. The casing is designed to withstand high pressures, forces, and environmental factors it will be subjected to in a wellbore, and maintain integrity throughout the production of the well until it is sealed and abandoned. Once the casing is placed in the wellbore, a cement slurry is pumped through the casing and into the annulus to fill the space between the outer diameter of the casing and the well bore wall. Upon curing, the cement permanently seals the casing to the wellbore.

Currently there are tools available to accurately evaluate the integrity of cementing jobs. However, these tools have several limitations. This is reflected by several well statistics that show that 2-10% of wells drilled in the last 15 years have integrity issues related to casing and cementing. Casing and cementing failures can result in well blowouts, contamination of aquifers, corrosion of casing and production tubing, contamination of production oil and gas, as well as the cessation of production due to well collapse or threat of well blowout. Moreover, casing and cementing failures can also affect the downhole environment and production potential of other wells in the vicinity. The current tools evaluate cement based on acoustic techniques. The tools are lowered inside the wellbore after cementing operations are completed. The tools depend on 'knocking on the pipe' and 'listening' for a response.

SUMMARY

Embodiments disclosed here provide a method of evaluating cement sheath integrity using passive, wireless sensors that are pumped into the wellbore with the cement slurry, and embedded in the cement sheath. The sensors provide information on the elastic constitutive properties of cement sheath such as compressive strength, and also parameters of the cement sheath environment, such as temperature, pressure, humidity, pH, and gases inside the cement sheath. The sensing is performed in situ and the results are transferred wirelessly to a reader that can be lowered into a wellbore through a wireline or as a component of a drilling assembly. Alternatively, the data can be transferred wirelessly to micro-devices that can be circulated through drilling fluids, or to devices that are permanently installed on casing collars. By identifying potential issues about the structural integrity of the cement sheath, timely warnings can be provided to perform remedial actions.

Accordingly, one example embodiment is a method for wirelessly sensing downhole cement sheath parameters. The method includes dispersing one or more wireless mobile devices in a cement slurry, pumping the cement slurry including the one or more wireless mobile devices through a casing for cementing the casing to the wellbore wall, sensing one or more cement sheath parameters by the one or more wireless mobile devices, transmitting a signal including the one or more sensed cement sheath parameters, and receiving the signal including the one or more sensed cement sheath parameters by a receiver wirelessly connected to the one or more wireless mobile devices.

Another example embodiment is a system for wirelessly sensing downhole cement sheath parameters. The system includes one or more wireless mobile devices embedded in the cement sheath between a casing and the wellbore wall of a subsurface formation. The one or more wireless mobile devices include one or more sensors configured to sense one or more cement sheath parameters. The system also includes a receiver wirelessly connected to the one or more wireless mobile devices. The receiver is configured to receive a signal including the one or more sensed cement sheath parameters.

Another example embodiment is a wireless mobile device for wirelessly sensing downhole cement sheath parameters. The device includes a sensor configured to sense a cement sheath parameter, a piezoelectric crystal configured to receive an acoustic wave and convert the acoustic wave into electric energy, and a power management unit configured to receive the electric energy and power the sensor. The device may further include a microcontroller adapted to receive measurement data from the sensor and generate an output signal including the measurement data, and a modulator adapted to receive the signal including the measurement data, and modulate the power or amplitude of the signal. The piezoelectric crystal can be further configured to transmit the modulated signal.

BRIEF DESCRIPTION OF DRAWINGS

For simplicity and clarity of illustration, the drawing figures illustrate the general manner of construction, and descriptions and details of well-known features and techniques may be omitted to avoid unnecessarily obscuring the discussion of the described embodiments. Additionally, elements in the drawing figures are not necessarily drawn to scale. For example, the dimensions of some of the elements in the figures may be exaggerated relative to other elements to help improve understanding of the example embodiments. Like reference numerals refer to like elements throughout the specification.

DETAILED DESCRIPTION

The methods and systems of the present disclosure will now be described with reference to the accompanying drawings in which embodiments are shown. The methods and systems of the present disclosure may be in many different forms and should not be construed as limited to the illustrated embodiments set forth here; rather, these embodiments are provided so that this disclosure will be thorough and complete, and will fully convey its scope to those skilled in the art.

The term "wireless mobile device" refers to a micro-chip for sensing one or more downhole cement sheath parameters. The micro-chip may include a sensor, a microcontroller or a microprocessor, and a transceiver. The micro-chip may, in some embodiments, include at least one of a modulator, an amplifier, a power storage unit, a power management unit, a piezoelectric crystal, and a memory unit. The term "high temperature" refers to temperatures greater than 125 degrees Celsius or 257 degrees Fahrenheit unless otherwise noted. The term "high pressure" refers to pressures greater than 15,000 psi unless otherwise noted. The term "high vibration" refers to vibrations over 30 g peak at 50-1000 Hz unless otherwise noted.

Figure 1:
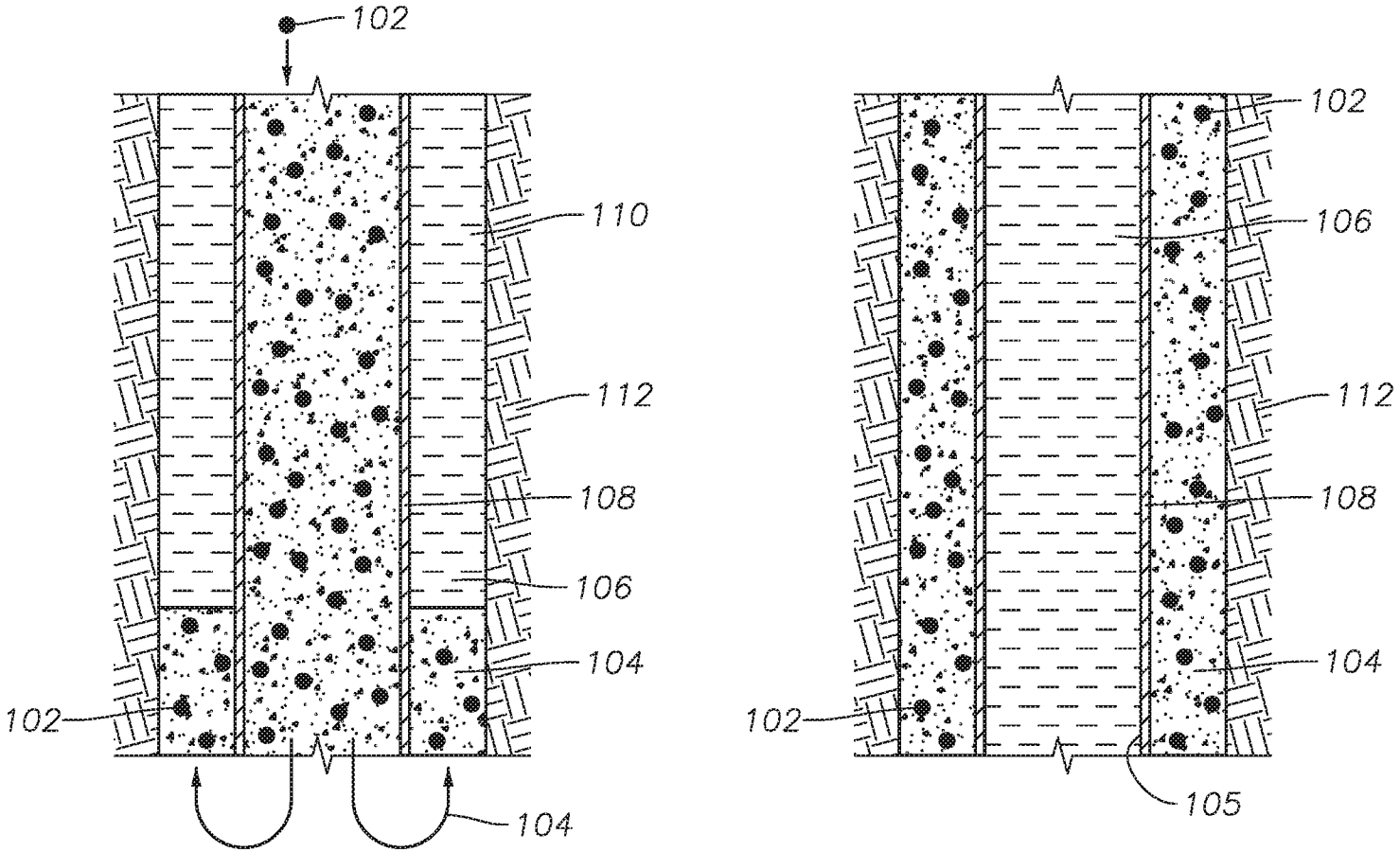
FIG. 1 illustrates a method for wirelessly sensing downhole cement sheath parameters, according to one or more example embodiments.

Turning now to the figures, FIG. 1 illustrates a method for wirelessly sensing downhole cement sheath parameters, according to one or more example embodiments. In one embodiment, one or more passive, wireless mobile devices 102 are dispersed into and pumped from the surface with a cement slurry into a wellbore 105 to be embedded in the cement sheath 104. Unlike current tools that have the sensors and actuators outside the cement sheath 104, this method has information gathering sensors and actuators inside the cement sheath 104. Moreover, the sensors and actuators in the wireless mobile devices 102 are passive compared to the active sensors used in current tools. Therefore, once embedded, these wireless mobile devices 102 can be activated wirelessly to measure and provide measured properties, such as the compressive strength of cement sheath, as well as properties of the cement sheath environment, such as temperature, pressure, strain, stress, humidity, pH, and gases present in the cement sheath 104.

The wireless mobile devices 102 are pumped through a casing 108 and down a wellbore 105 with the cement slurry in a coordinated manner so that sufficient wireless mobile devices 102 cover the whole column of cement sheath 104 in the wellbore 105. The cement slurry is preceded and succeeded by pumping of a drilling fluid 106, both of which flow from inside the casing 108 out into the annulus 110 between the casing 108 and the wellbore wall of the subsurface formation 112, and back to the surface. Redundancy in a given area of the cement sheath 104 is also important to nullify any attenuation of sensor signals due to irregularities in the cement sheath pathway during the wireless interrogation of sensors, and transmission of sensor signals back to the interrogator or reader. As the cement slurry hardens over a period of time, the wireless mobile devices 102 also set in place and are permanently embedded in the cement sheath 104. The wireless mobile devices 102 can be spherical or any other shape, such as a cube or a capsule, which does not affect the quality or integrity of the cement sheath 104. The wireless mobile devices 102 can include a coating (not shown) that can be a polymer such as elastomer or any material that can withstand high pressure, temperature, stress, and strain. The coating can also be made from a material that bonds well with the cement sheath 104 and does not leave any gap between the cement sheath 104 and the wireless mobile device 102.

The wireless mobile devices 102, once embedded in cement sheath 104, can remain there indefinitely and provide information about cement sheath properties. The wireless mobile devices 102 do not require a power source, such as a battery for operation, resulting in small sizes, and long lifetimes. Batteries are expensive, have finite lifetimes, and the presence of a significant number of batteries in a well is a critical hazard due to their chemical content, and the possibility of its leakage. Even though the wireless mobile devices 102 are in a difficult to access, harsh environment, they can be powered wirelessly.

Figure 2B:
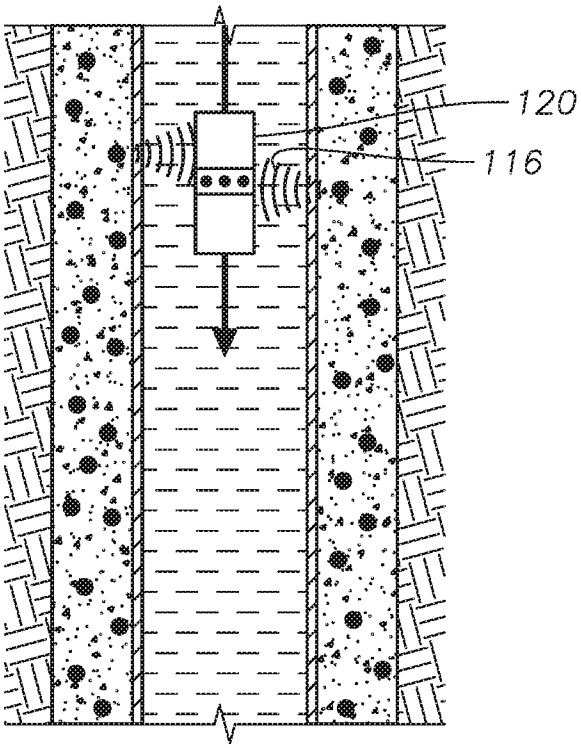
FIGS. 2A-2C illustrate a schematic of a wireless mobile device in a system for wirelessly sensing downhole cement sheath parameters, according to one or more example embodiments.
Figure 2A:
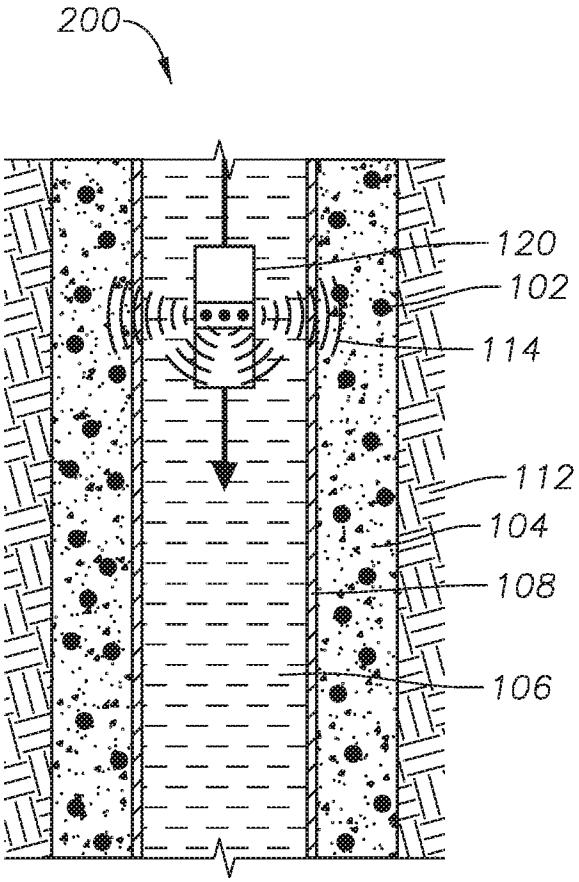
Figure 2C:
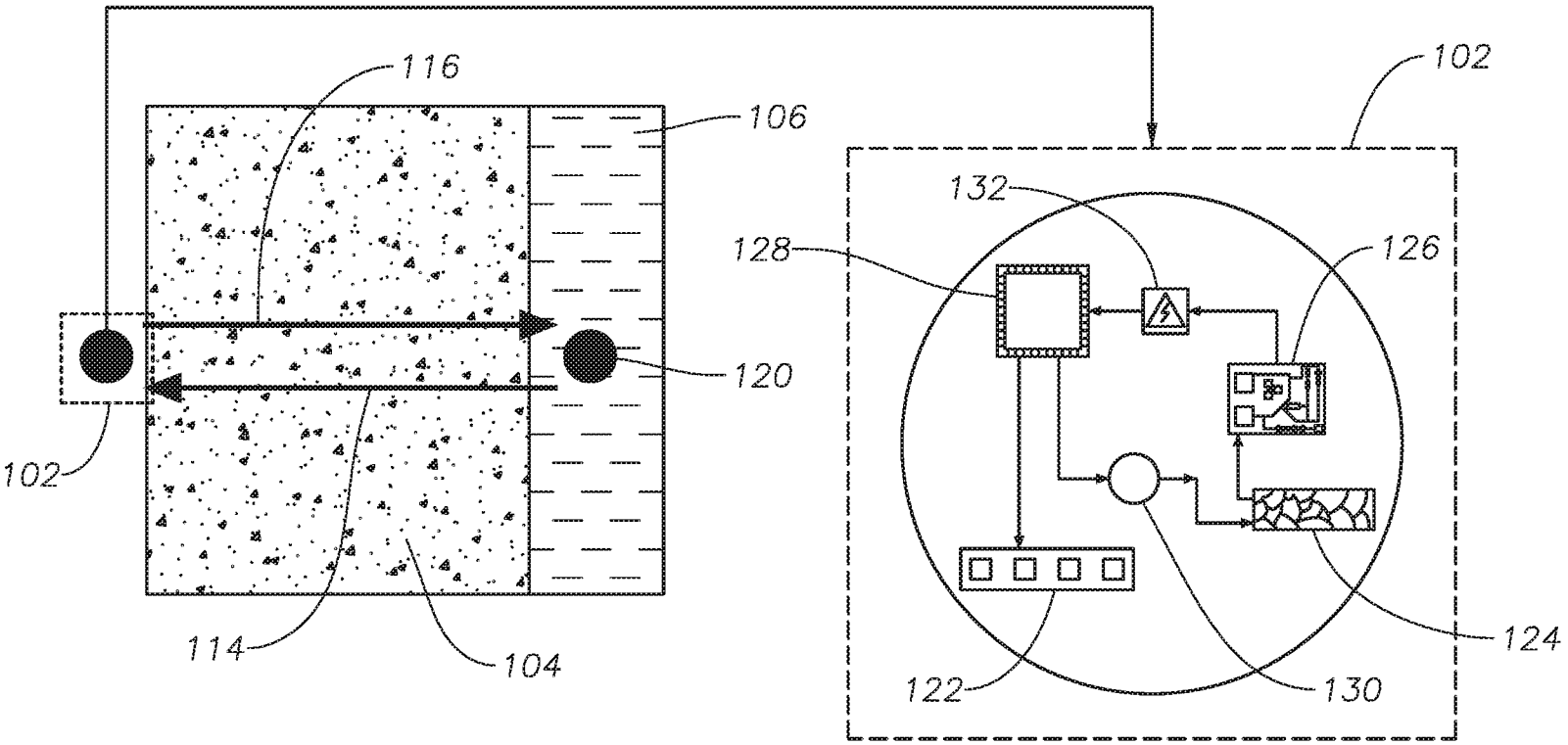

FIG. 2A and FIG. 2B illustrate a system 200 for wirelessly sensing downhole cement sheath parameters, according to one or more example embodiments. In one embodiment, an interrogator or reader 120 transmits acoustic waves 114 to the wireless mobile devices 102 and this acoustic energy 114 is converted to mechanical energy through a vibrating cavity, membrane, diaphragm, or a cantilever, and then converted to electrical energy through a piezoelectric crystal 124, shown in FIG. 2C. FIG. 2C illustrates a cross-sectional view (box with a dotted line) of a wireless mobile device 102, according to one or more example embodiments. A piezoelectric crystal 124 is used to convert acoustic waves 114 to electrical signals to drive a passive inductor-capacitor (LC) sensor 122. The wireless activation of the passive LC sensors 122 can be performed by lowering a tool with an acoustic interrogator or reader 120 into the casing 108. A power management unit 126 performs the role of power conditioning and management by ensuring the unprocessed acoustic power is compatible with the load of the LC circuit. The impedances are matched for power transfer optimization and maximize the efficiency of power consumption. Since the sensors 122 are passive and the capacitive element is self-powered, only an alternating current (AC) waveform needs to be supplied to the LC circuit to obtain its output impedance. The output impedance of the passive LC sensors 122 are then modulated by a modulator 130 and transmitted as an acoustic wave 116 utilizing the piezoelectric crystal 124. The interrogator or reader 120 now acts as a receiver and reads the acoustic waves 116 from the wireless mobile devices 102 and converts them to intelligible information that gives an indication about the integrity of the cement sheath 104. Acoustic energy can be transferred at higher efficiencies and over longer distances when compared to electromagnetic energy that can be transferred using transmitters and receivers of the same size. However, in electromagnetic energy transfer, the efficiency drops significantly when the transmission distance becomes larger than the coil diameter.

Wireless mobile device 102 may also include a microcontroller 128 to receive measurement data from the sensor and generate an output signal including the measurement data. A power storage unit 132 such as a regular di-electric capacitor de-rated for use at high temperatures, a ceramic, an electrolytic, or a super capacitor can be provided in the wireless mobile device 102 for storing the energy produced. The sinusoidal electrical waveform can be rectified and conditioned by the power management circuit 126 to charge the storage unit 132. In such a case, the sensors 122 are not limited to passive LC sensors and any active, low-power commercially available sensor can be used in the wireless mobile device 102, and the power storage unit 132 can be used to provide power to the sensors 122. If the wireless mobile device 102 includes a power storage component, then active ultrasonic sensors can also be used as a method to evaluate the integrity of cement sheath 104.

Figure 3A:
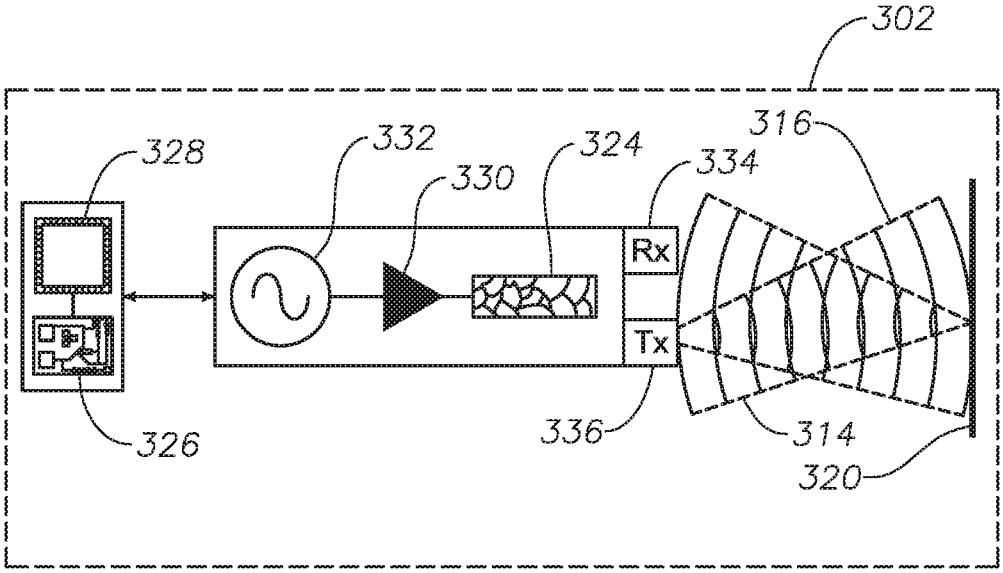
FIGS. 3A-3D illustrate a schematic of a wireless mobile device in a system for wirelessly sensing downhole cement sheath parameters, according to one or more example embodiments.
Figure 3B:
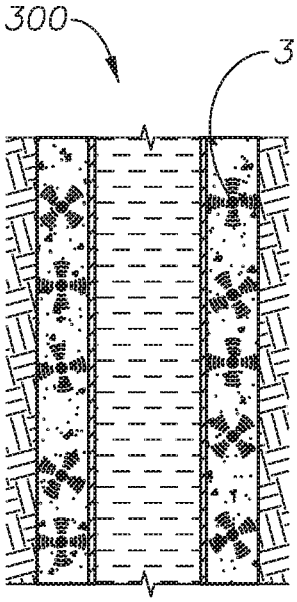
Figure 3C:
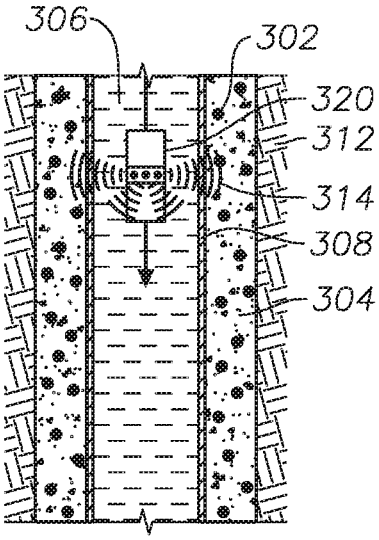
Figure 3D:
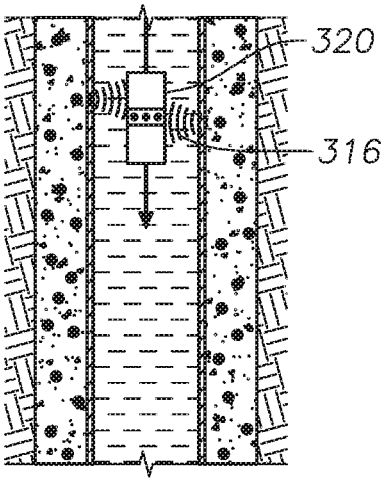

FIG. 3A-D illustrate a system 300 for wirelessly sensing downhole cement sheath parameters in a subsurface formation 312, according to one or more example embodiments. Wireless mobile devices 302 may also include a microcontroller 328 to receive measurement data from the sensor and generate an output signal including the measurement data, as shown in FIG. 3A. A power storage unit 332 such as a regular di-electric capacitor de-rated for use at high temperatures, a ceramic, an electrolytic, or a super capacitor can be provided in the wireless mobile device 302 for storing the energy produced. The sinusoidal electrical waveform can be rectified and conditioned by the power management circuit 326 to charge the storage unit 332. In such a case, the sensors are not limited to passive LC sensors and any active, low-power commercially available sensor can be used in the wireless mobile device 302, and the power storage unit 332 can be used to provide power to the sensors. If the wireless mobile device 302 includes a power storage component, then active ultrasonic sensors can also be used as a method to evaluate integrity of the cement sheath 304. FIGS. 3A and 3B show how an omnidirectional ultrasonic transceiver 302 can reveal the integrity of the surrounding cement sheath by generating pulses 316 in different directions by a transmitter 336 and then receiving and evaluating the properties of the echo pulses through a receiver 334. The acoustic waves are generated by driving the piezoelectric crystal 324 by a power source 332 through an amplifier 330. The received echo pulses are analyzed by the signal processing unit 326 and stored inside the memory of the microcontroller 328. By evaluating the time of flight, Doppler shift, and amplitude attenuation properties such as sensing distance, velocity, and directionality, attenuation coefficient can be obtained. In one embodiment as shown in FIG. 3C, an interrogator or reader 320 is lowered into the cased hole 306, which is isolated from the rock formation 312 by a casing 308. The interrogator or reader 320 transmits acoustic waves to the wireless mobile devices 302 and the acoustic energy contained in the acoustic wave is converted to mechanical energy through a vibrating cavity, membrane, diaphragm, or a cantilever, and then converted to electrical energy through a piezoelectric crystal 324, shown in FIG. 3A. The piezoelectric crystal 324 is used to convert acoustic wave 314 to electrical signals and to send a request to the microcontroller memory to transfer the stored data to the reader. The wireless triggering to obtain data from the memory of the wireless microchip can be performed by lowering a tool with an acoustic interrogator or reader 320 into the casing 308, as shown in FIG. 3D. A signal processing unit 326 performs the role of signal conditioning and management by ensuring the stored data in the microcontroller 328 memory is transferred to the reader as an acoustic wave by utilizing the piezoelectric crystal 324. The impedances are matched for power transfer optimization and maximize the efficiency of power consumption. As shown in FIG. 3D, the interrogator or reader 320, which may be lowered into wellbore 306, now acts as a receiver and reads the acoustic waves 316 from the wireless mobile devices 302 and converts them to intelligible information that gives an indication about the integrity of the cement sheath 304.

Figure 4A:
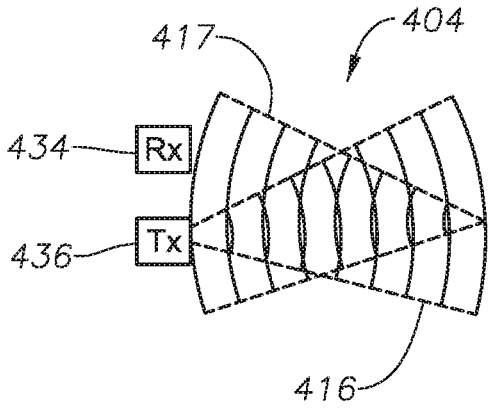
FIGS. 4A-4D illustrate data analysis performed in a system for wirelessly sensing downhole cement sheath parameters, according to one or more example embodiments.
Figure 4B:
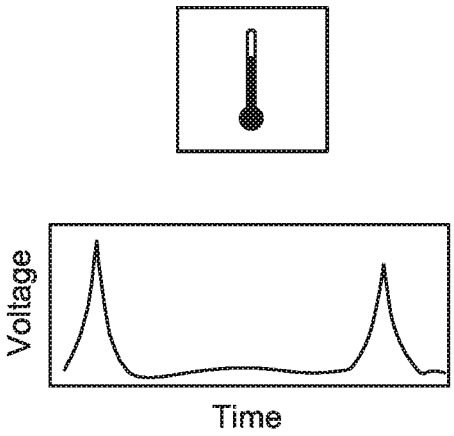
Figure 4C:
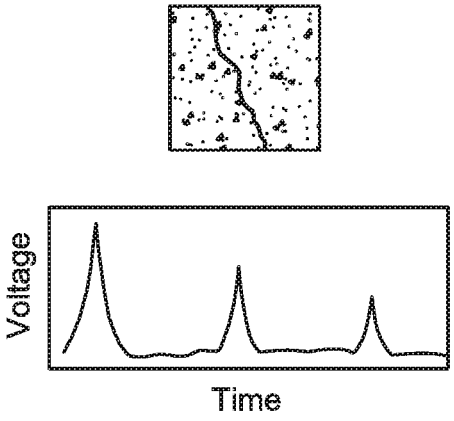
Figure 4D:
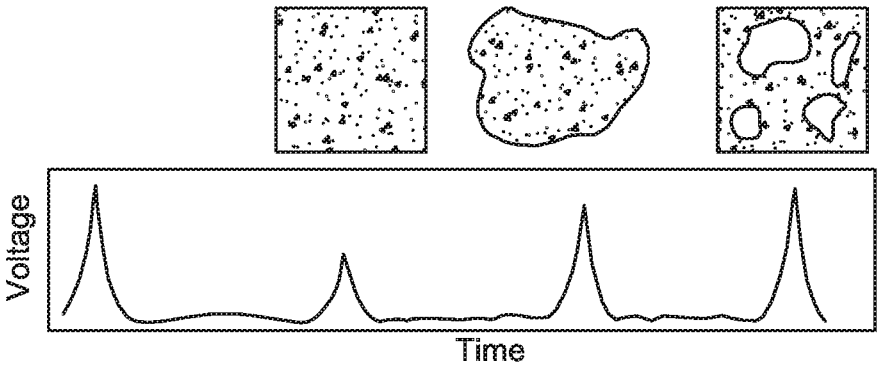

FIGS. 4A-4D illustrates data analysis performed in a system for wirelessly sensing downhole cement sheath parameters, according to one or more example embodiments. As illustrated in FIG. 4A, the signals 416 transmitted by the transmitter 436, receiver 434 may be used to determine one or more properties of the cement sheath 404 by analyzing the reflected signal 417. By evaluating the time of flight, Doppler shift, and amplitude attenuation, properties such as distance, velocity, directionality, and attenuation coefficient can be obtained using the system of the present disclosure. The amplitude of the reflected waveform can be used to measure the temperature of the cement sheath (as shown in FIG. 4B), identify cracks in the cement sheath (as shown in FIG. 4C), and also the quality of the cement sheath (as shown in FIG. 4D). One advantage in having ultrasonic sensors inside the cement sheath is that the coating of the wireless mobile devices can be tuned to match the impedance of the cement sheath so that any wave reflected back to the wireless mobile device will be due to a mismatched boundary in the cement sheath. This way integrity issues such as a crack or a microannulus can be accurately located in the cement sheath as waves are reflected from their boundaries. These signals can be processed by the signal processing electronics, and the microcontroller 128, 328, and stored in a memory (not shown). The interrogator or reader 120, 320 can then be used to obtain the signals stored in the memory.

Figure 5:
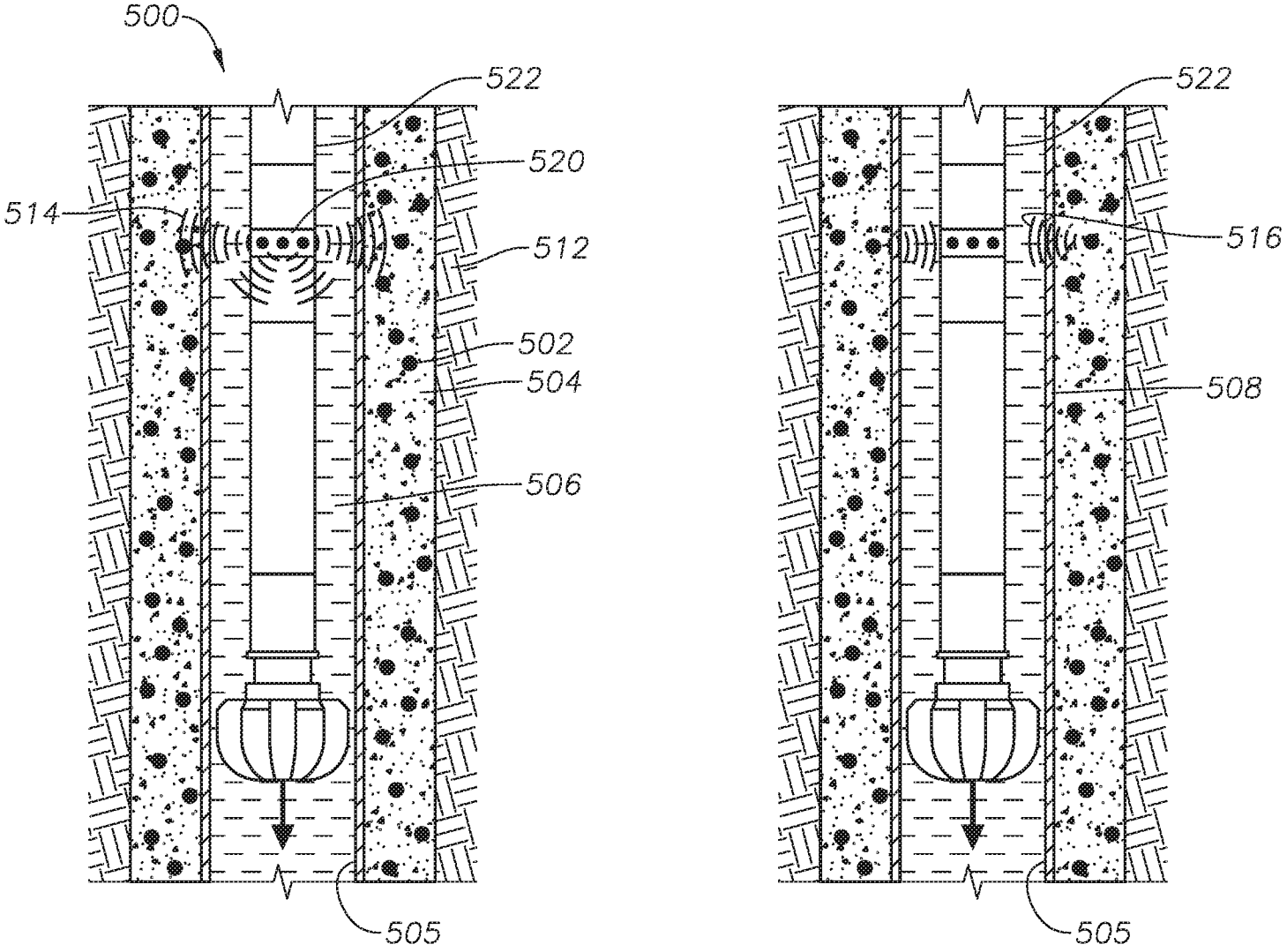
FIG. 5 is a schematic of a system for wirelessly sensing downhole cement sheath parameters, according to one or more example embodiments.

FIG. 5 is a schematic of a system 500 for wirelessly sensing downhole cement sheath parameters, according to one or more example embodiments. In this embodiment, the interrogator or reader 520, which may be lowered into wellbore 506, is connected to a drilling assembly 522 that may be used to further drill the well deeper. The sensor output signals 516 from the wireless mobile devices 502 can be obtained when the drilling assembly 522 is run inside the wellbore 505 to drill a new formation 512 after cementing the previous formation. The interrogator or reader 520 may send the interrogation acoustic wave 514 to receive the sensor output acoustic wave 516. The sensor signals 516 received by the interrogator or reader 520 can be transferred to the surface using, for example, mud pulse telemetry.

Figure 6:
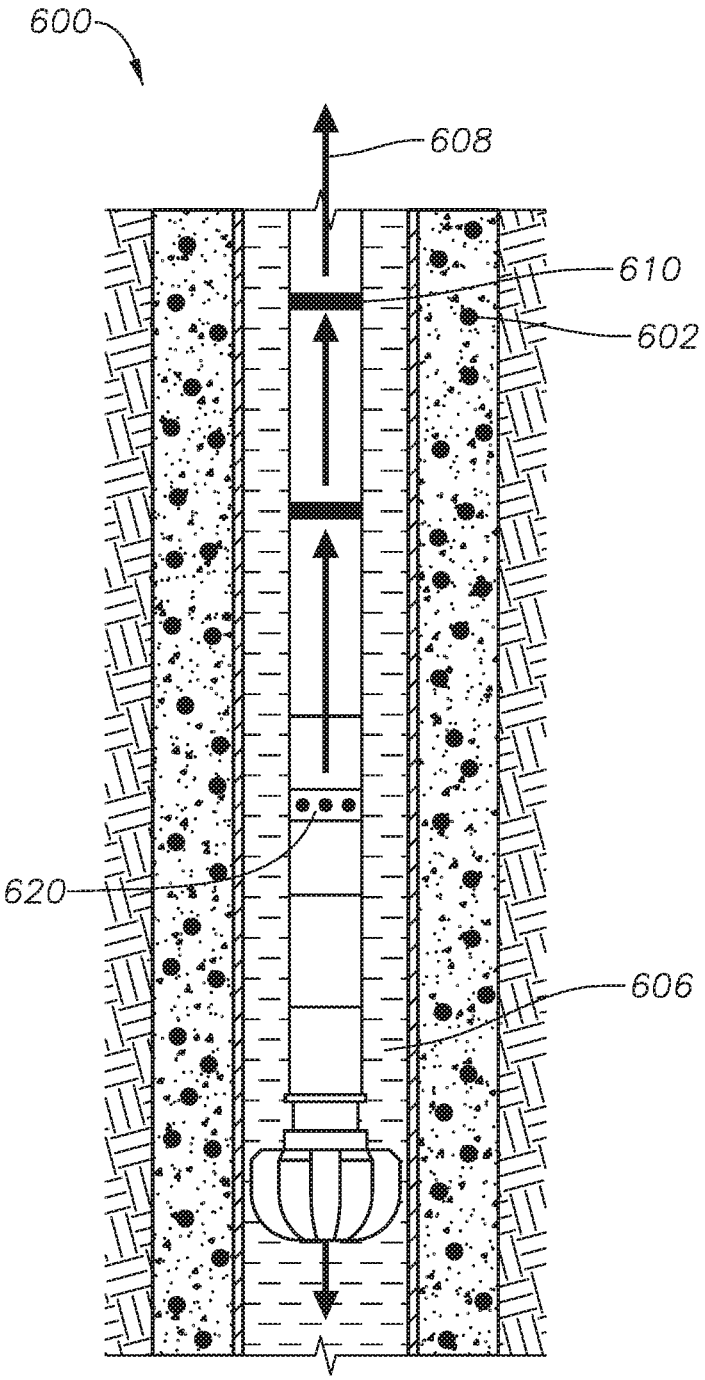
FIG. 6 is a schematic of a system for wirelessly sensing downhole cement sheath parameters, according to one or more example embodiments.

FIG. 6 is a schematic of a system 600 for wirelessly sensing downhole cement sheath parameters, according to one or more example embodiments. System 600 includes wireless transmission rings 610 installed above the interrogator or reader 620. Wireless mobile devices 602 may transmit signals containing sensor information to the interrogator 620. The rings 610 are connected in a way to transfer the sensor information from one ring to another, all the way to the surface using low power wireless technologies 608 such as low-power Wi-Fi, Wi-Fi direct, Bluetooth, Bluetooth Low Energy, ZigBee, etc. The power to the rings 610 can be provided by energy harvesting charge pods that contain a mini-turbine and two materials of opposite polarities that are driven towards each other by the motion of the turbine due to the drilling fluid 606 flow. The contact and separation motion of the two materials can produce electricity to power the rings 610.

Figure 7:
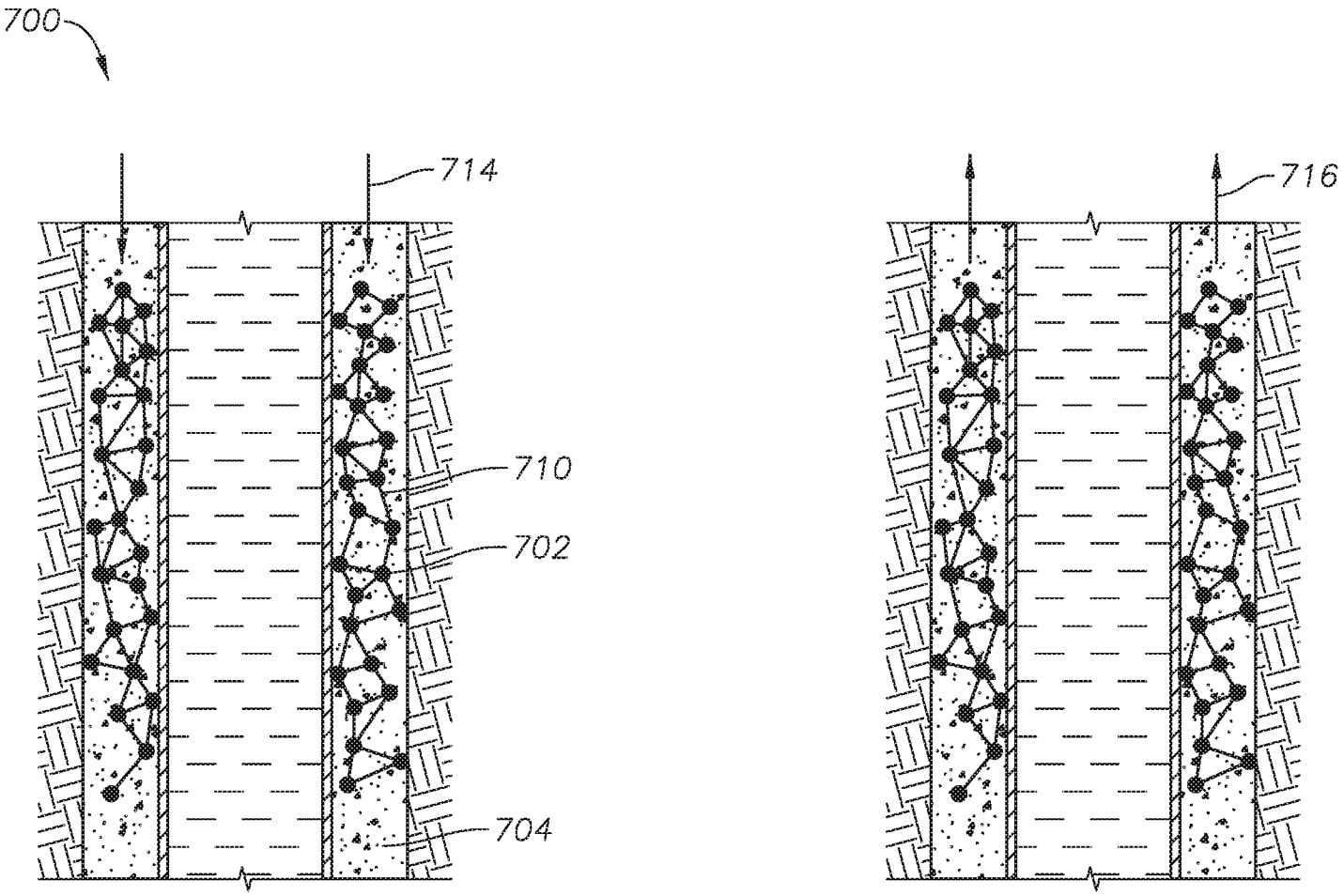
FIG. 7 is a schematic of a system for wirelessly sensing downhole cement sheath parameters, according to one or more example embodiments.

FIG. 7 is a schematic of a system 700 for wirelessly sensing downhole cement sheath parameters, according to one or more example embodiments. In this embodiment, the wireless mobile devices 702 can be organized as a wireless sensor network 710. The wireless mobile devices 702 are interrogated from the surface and the interrogation signal 714 is passed down the wireless mobile devices 702 all the way to the bottom of the cement sheath 704. The wireless mobile devices 702 then send sensor signals 716 with information about depth along the mesh network 710 from the bottom of the cement sheath 704 to the surface where a reader can receive the signals 716. The signals 716 can then be utilized to obtain a three-dimensional map of the cement sheath 704. The signal transmission can be RF or acoustic where the transmission distance can be pre-programmed or tuned by the interrogation signal 714.

Figure 8:
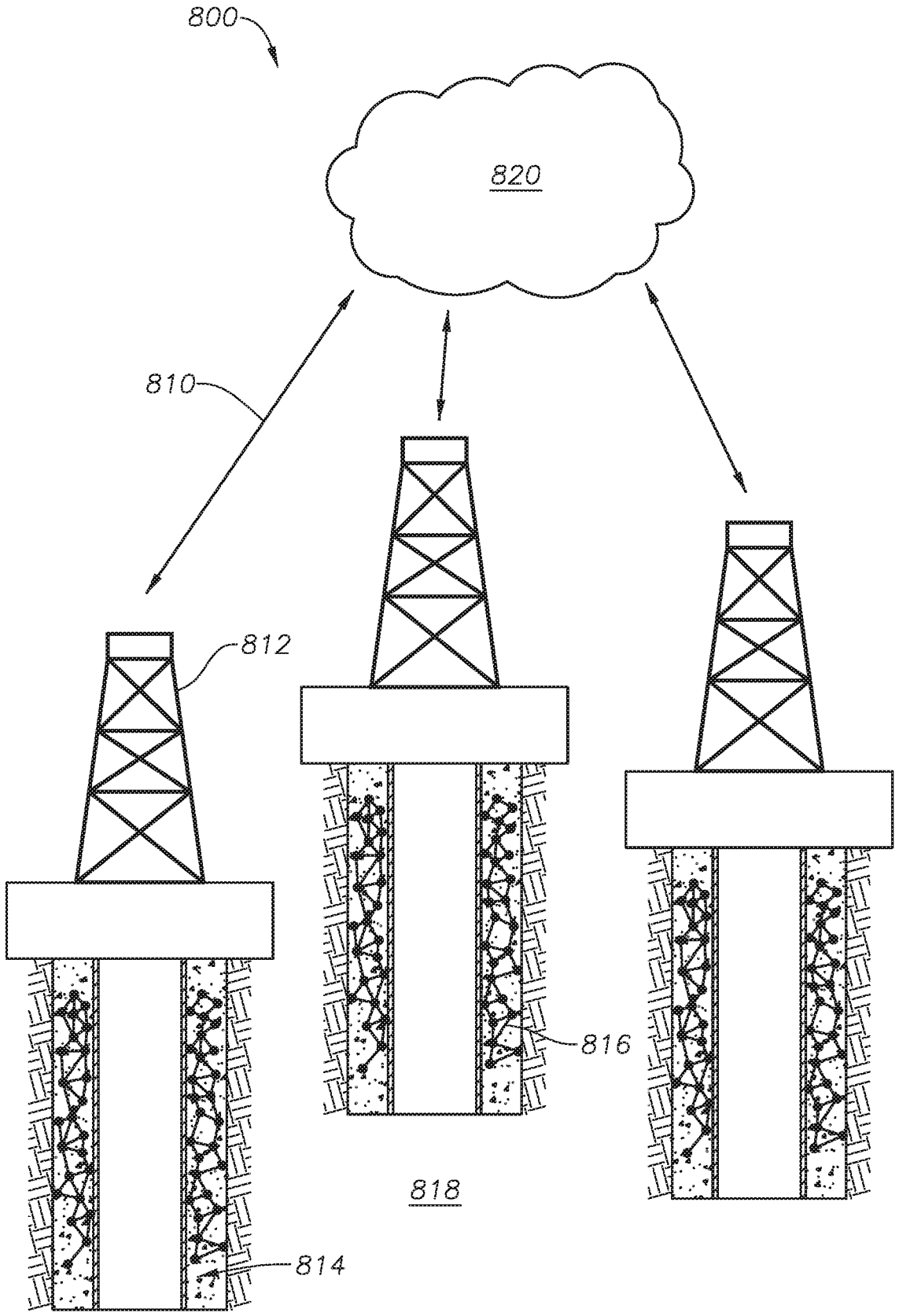
FIG. 8 is a schematic of a system for wirelessly sensing downhole cement sheath parameters, according to one or more example embodiments.

FIG. 8 is a schematic of a system 800 for wirelessly sensing downhole cement sheath parameters, according to one or more example embodiments. System 800 includes one or more oil or gas rigs 812 that may each include a sensor mesh network 816. Readers on different wells 814 can be connected to wireless gateways 812 on each well 814, which in turn can be connected to a remote server 820 to create a regularly updated database of the integrity of the cement sheath in wells in an oil or gas field 818. Cement sheath integrity data 810 from each of the wells 814 may be transmitted to the remote server 820 for storage and analysis of the data.

Figure 9:
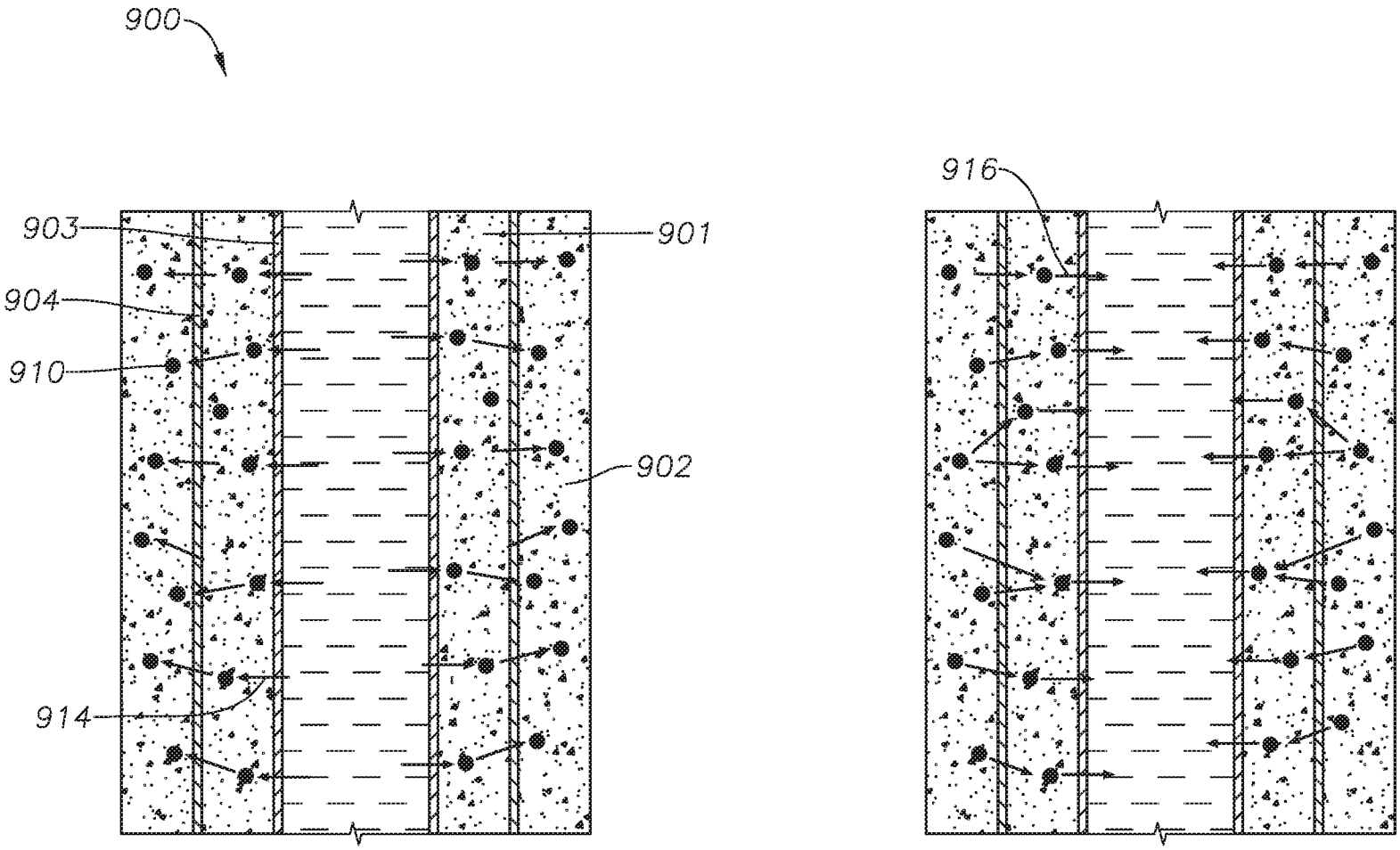
FIG. 9 is a schematic of a system for wirelessly sensing downhole cement sheath parameters, according to one or more example embodiments.

FIG. 9 is a schematic of a system 900 for wirelessly sensing downhole cement sheath parameters, according to one or more example embodiments. As shown in FIG. 9, the wireless mobile devices 910 between different layers of the cement sheath 901, 902 can be communicably coupled in a way so that signals 914 sent by the acoustic interrogator or reader embedded in the casings 903, 904 can be relayed from one layer of casing 903 to another 904 by the wireless mobile devices 910, and the sensor signal 916 can be transmitted back from the wireless mobile devices 910 to the interrogator or reader embedded in the casings 903, 904.

Figure 10A:
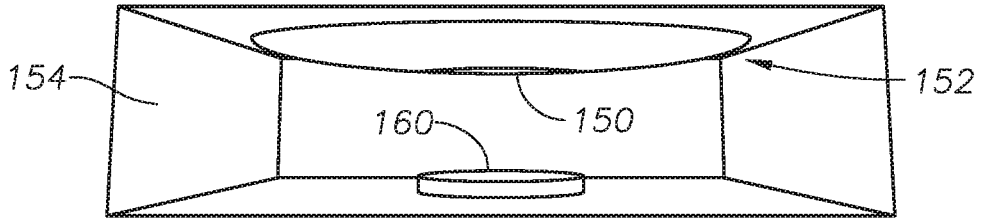
FIGS. 10A-10F illustrates schematics of a sensor configuration in a wireless mobile device for sensing downhole cement sheath parameters, according to one or more example embodiments.

FIGS. 10A-10F illustrate a transducer portion of a sensor in a wireless mobile device 102, 302, 502, 602, 702, 910 for sensing downhole cement sheath parameters, according to one or more example embodiments. FIG. 10A illustrates a sensing device that includes a flexible structure 152 that can expand and compress. This structure 152 is made of a shape-memory material, which can be a shape-memory alloy, polymer, gel, ceramic, or combinations thereof. The main advantage of a shape-memory material is its remarkable property to recover to its original shape after changing shape due to an external stimuli. The external stimuli can be temperature, pressure, stress, strain, current, voltage, magnetic field, pH, humidity, gas or light. Moreover, a shape memory material can be programmed to respond and change shape due to any specific stimulus. The sensor may also include a housing 154, which will be described in further detail in later parts of the disclosure.

Figure 10B:
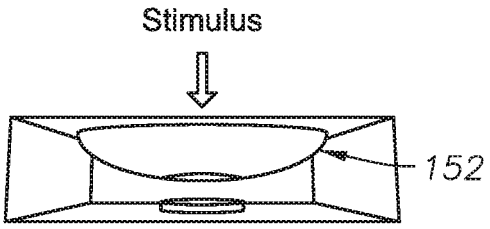
Figure 10C:
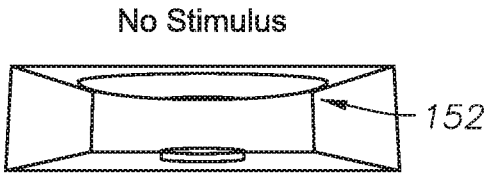
Figure 10D:
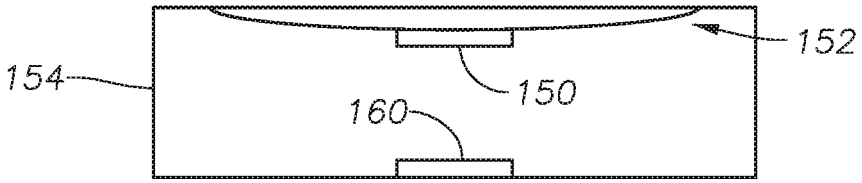
Figure 10E:
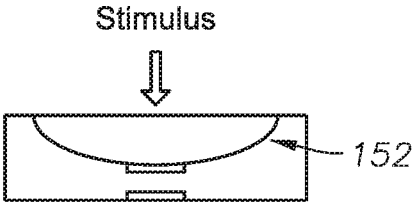
Figure 10F:
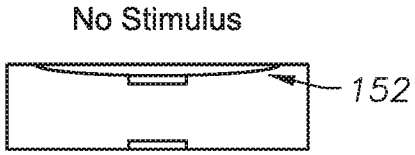

The structure 152 can be linked either directly or indirectly to a metal electrode 150 that conducts electricity. Directly below this drive electrode 150 is another metal electrode, the ground electrode 160, which can be fixed. The drive electrode 150 and the ground electrode 160 act as a parallel-plate capacitor, where the drive electrode 150 and ground electrode 160 are separated by a non-conductive region. Note that the electrode 160 can also act as a drive electrode, in which case the electrode 150 will act as the ground electrode to form the parallel-plate capacitor. When a voltage is applied to the drive electrode 150 an electric field is produced between the drive electrode 150 and the ground electrode 160 and the sensor behaves as a capacitor. The capacitance between the plates increases with decreasing distance between the drive electrode 150 and the ground electrode 160. For example, if the structure 152 responds to an external stimuli by expanding as shown in FIG. 10B, the drive electrode 150 linked to the structure 152 will approach the ground electrode 160 thereby decreasing the distance between the drive electrode 150 and the ground electrode 160. This change in the distance between the drive electrode 150 and the ground electrode 160 will be reflected by an increase in the capacitance between the drive electrode 150 and the ground electrode 160. Depending on the shape memory material utilized, the distance between the electrodes may remain the same until a change in the magnitude of the stimulus triggers a further change of its shape. Therefore, they can be programmed to change in steps to different magnitudes of external stimuli. FIGS. 10D-10F illustrate cross-sectional views of the structure illustrated in FIGS. 10A-10C, respectively.

Figure 11:
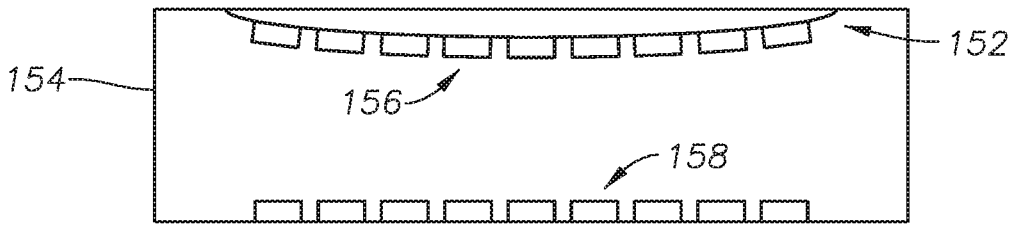
FIG. 11 is a schematic of a sensor configuration in a wireless mobile device for sensing downhole cement sheath parameters, according to one or more example embodiments.
Figure 11:
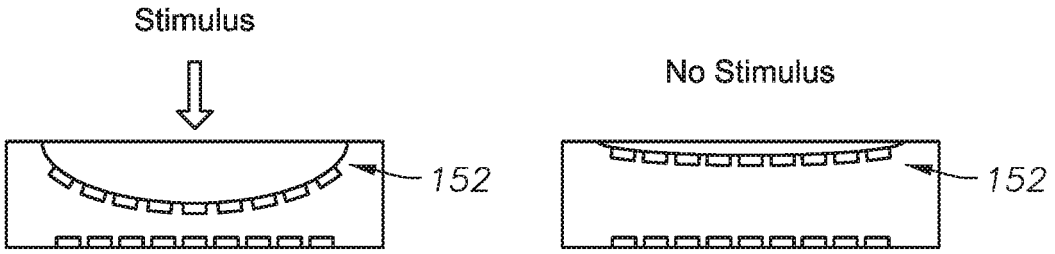

FIG. 11 illustrates a transducer portion of a sensor in a wireless mobile device 102, 302, 502, 602, 702, 910 for sensing downhole cement sheath parameters, according to one or more example embodiments. In this embodiment, the drive electrode 150 and ground electrode 160 can be repeated many times and be designed as an array 156, 158, where the change in distance between the array of electrodes 156, 158 gives rise to a change in capacitance.

Figure 12:
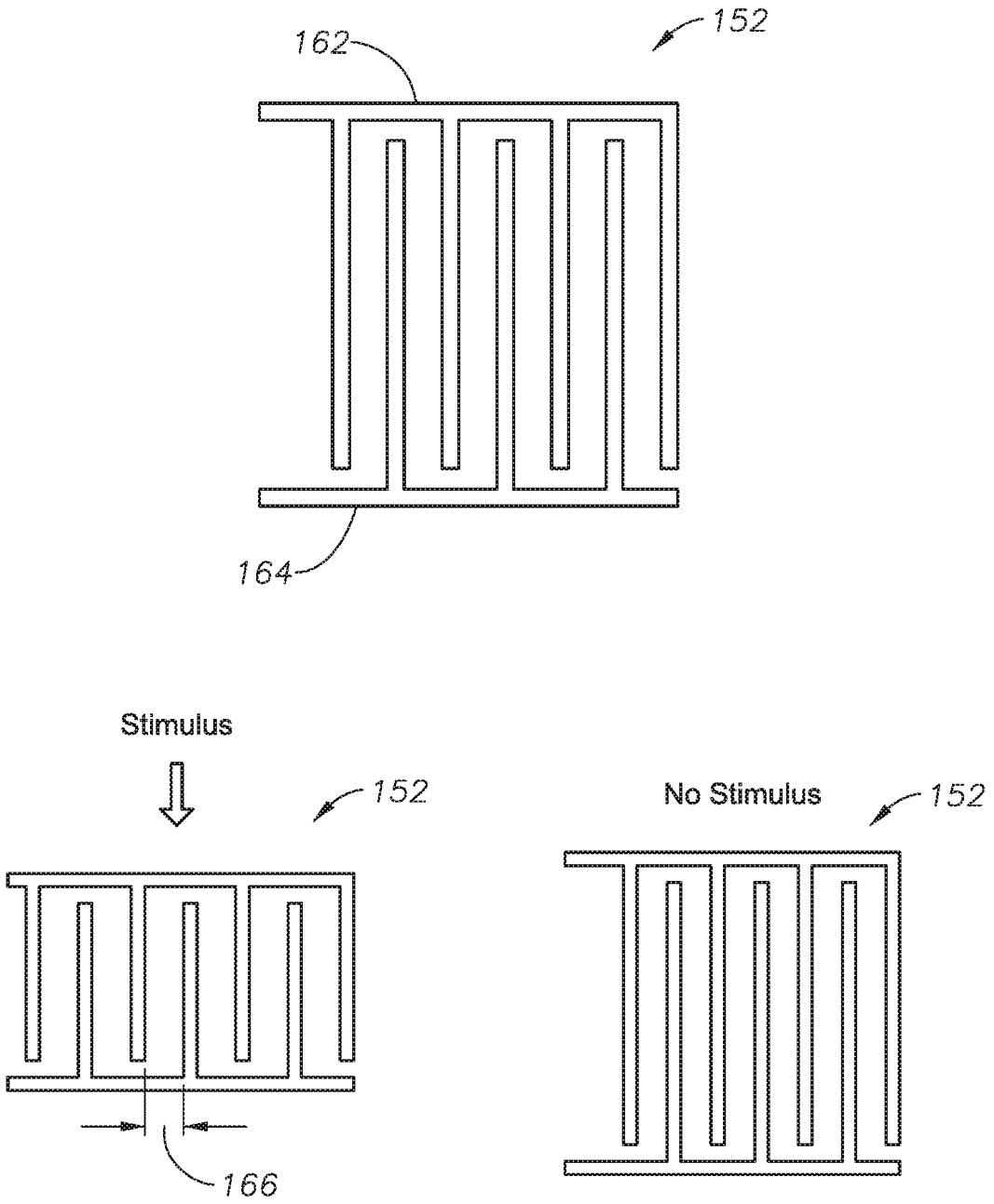
FIG. 12 is a schematic of a sensor configuration in a wireless mobile device for sensing downhole cement sheath parameters, according to one or more example embodiments.

FIG. 12 illustrates a transducer portion of a sensor in a wireless mobile device 102, 302, 502, 602, 702, 910 for sensing downhole cement sheath parameters, according to one or more example embodiments. In this embodiment, the drive electrode 150 and ground electrode 160 are designed as a flexible, planar interdigital array 162, 164, where the change in the shape of structure 152 will change the distance 166 between the drive electrode 162 and ground electrode 164 leading to a change in the capacitance.

Figure 13:
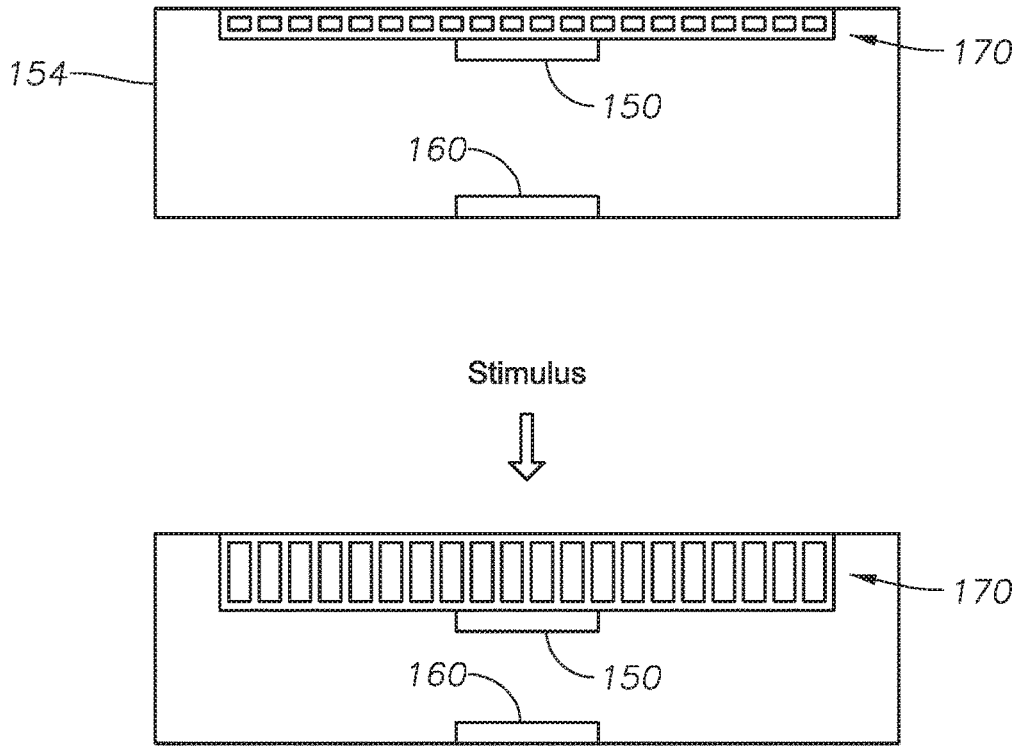
FIG. 13 is a schematic of a sensor configuration in a wireless mobile device for sensing downhole cement sheath parameters, according to one or more example embodiments.

FIG. 13 illustrates a transducer portion of a sensor in a wireless mobile device 102, 302, 502, 602, 702, 910 for sensing downhole cement sheath parameters, according to one or more example embodiments. In this embodiment, the drive electrode 150 is linked to an array of shape-memory alloys 170, such that when exposed to an external stimuli the shape-memory alloys 170 elongate, thereby driving the drive electrode 150 towards the ground electrode 160, and changing the capacitance.

Figure 14:
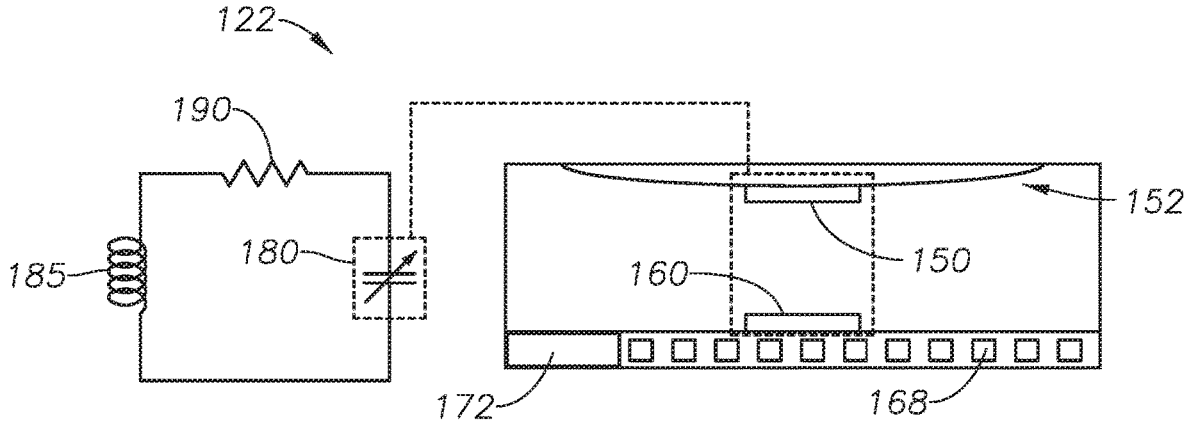
FIG. 14 is a schematic of a sensor configuration in a wireless mobile device for sensing downhole cement sheath parameters, according to one or more example embodiments.

FIG. 14 illustrates a sensor 122 in a wireless mobile device 102, 302, 502, 602, 702, 910 for sensing downhole cement sheath parameters, according to one or more example embodiments. In this embodiment, when the capacitor 180 is connected in series with an inductor 168, 185 and resistor 190, the circuit becomes a passive LC resonance sensor circuit. Sensor 122 may include electronic circuitry 172, which may include the resistor 190, and other components. Passive LC sensors have low power consumption and operating frequencies, and can be fabricated using microfabrication as microelectromechanical systems (MEMS) devices. They are lightweight, resulting in increased design flexibility, device capability, and reliability. A change in the capacitor response due to an external stimuli shifts the resonance frequency of the LC circuit. In some embodiments, the value of the inductance and any load resistance in the circuit remains the same, and only the capacitor linked to the structure changes as the structure responds to the external stimuli.

Figure 15A:
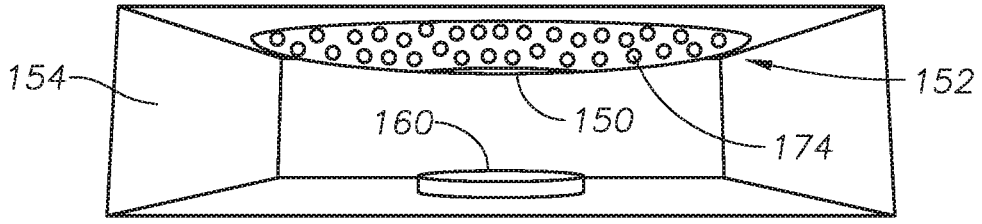
FIGS. 15A-15F illustrate schematics of a sensor configuration in a wireless mobile device for sensing downhole cement sheath parameters, according to one or more example embodiments.
Figure 15B:
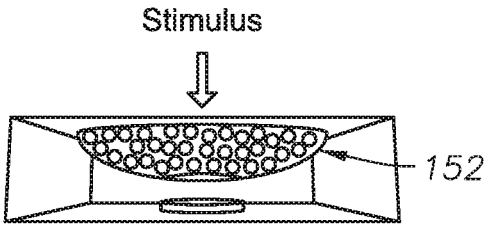
Figure 15C:
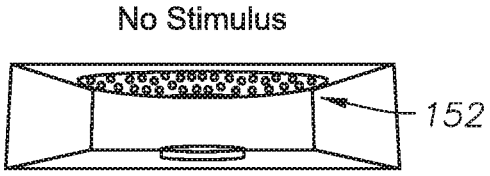
Figure 15D:
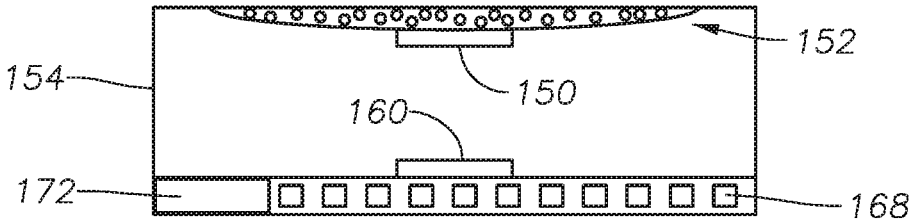
Figure 15E:
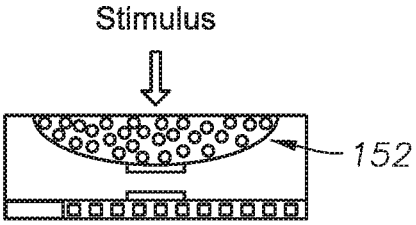
Figure 15F:
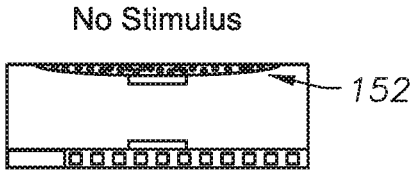

FIGS. 15A-15C illustrates a transducer portion of a sensor in a wireless mobile device 102, 302, 502, 602, 702, 910 for sensing downhole cement sheath parameters, according to one or more example embodiments. In this embodiment, a structure 152 containing shape-memory polymer particles 174 may be used as a transducer. The shape-memory polymer particles 174 expand to external stimuli pushing the drive electrode 150 towards the ground electrode 160. The cross-section of such a capacitor integrated with an inductor 168 forming an LC circuit is shown in FIGS. 15D-15F. The sensor in this example changes its resonant frequency according to the change in capacitance.

Figure 16:
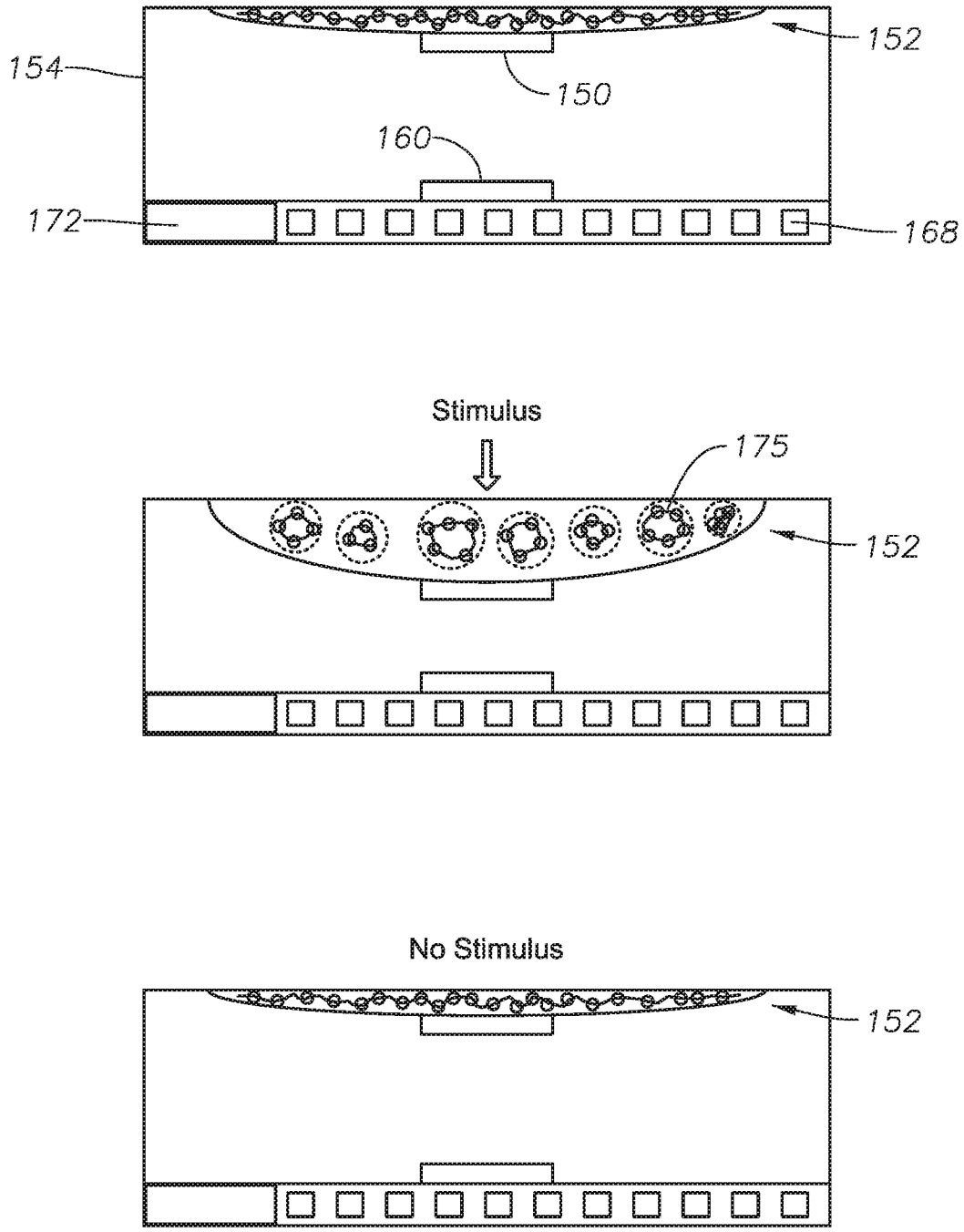
FIG. 16 is a schematic of a sensor configuration in a wireless mobile device for sensing downhole cement sheath parameters, according to one or more example embodiments.

FIG. 16 illustrates a transducer portion of a sensor in a wireless mobile device 102, 302, 502, 602, 702, 910 for sensing downhole cement sheath parameters, according to one or more example embodiments. In this embodiment, a structure 152 with shape-memory polymer particles 175 that have the ability to cross-link, and change the shape of the structure 152. An external stimulus leads to physical cross-linking between the particles 175 resulting in larger clusters of polymer particles 175 and a change in the shape of the structure 152. The level of crosslinking may depend on the magnitude of the stimulus.

Figure 17:
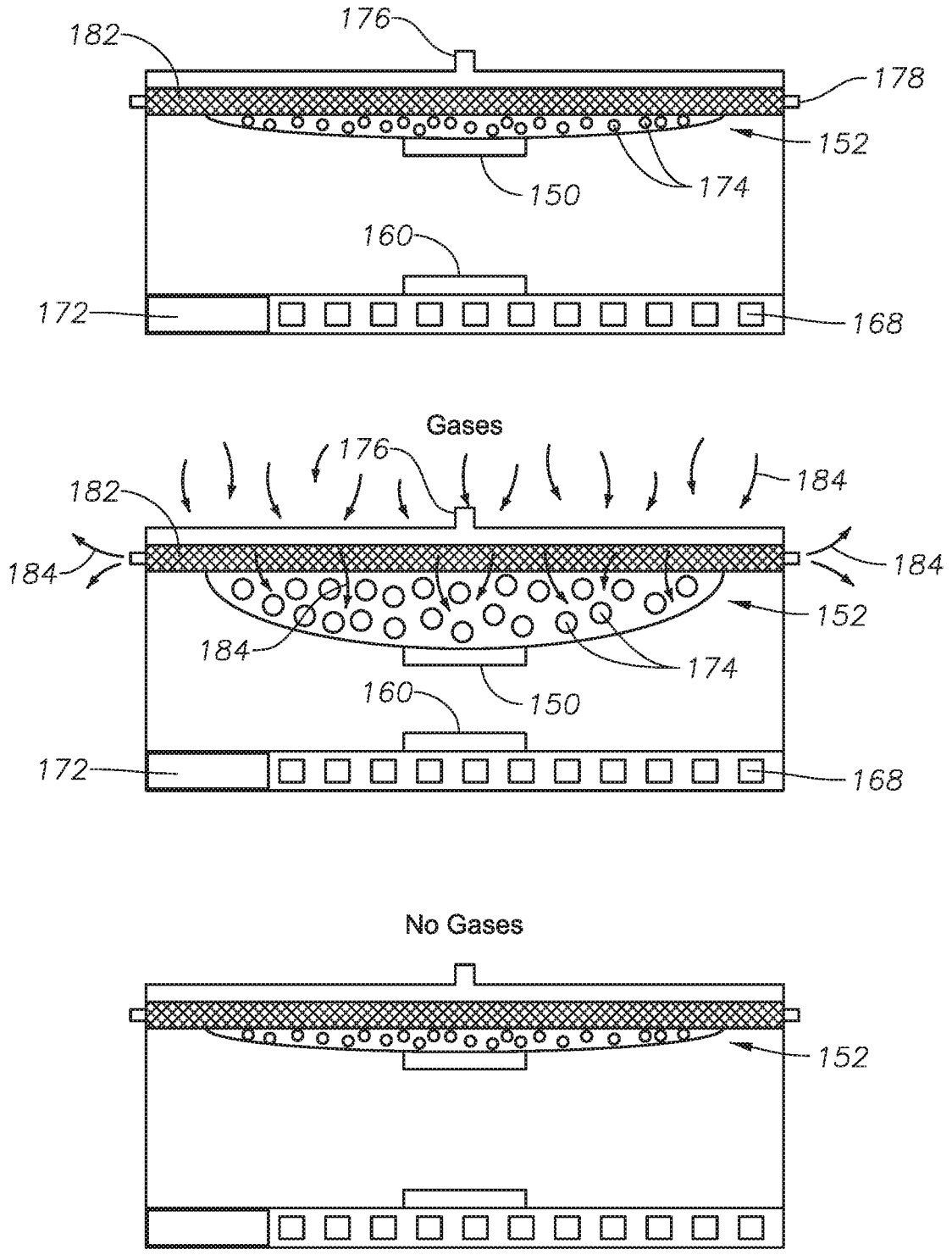
FIG. 17 is a schematic of a sensor configuration in a wireless mobile device for sensing downhole cement sheath parameters, according to one or more example embodiments.

FIG. 17 illustrates a transducer portion of a sensor in a wireless mobile device 102, 302, 502, 602, 702, 910 for sensing downhole cement sheath parameters, according to one or more example embodiments. In this embodiment, the LC sensor is shown acting as a gas sensor. The sensor has an opening 176 for the gases 184 to go through, a gas purging outlet 178, and a structure 152 with shape-memory polymers 174. When exposed to a given gas 184, the shape-memory polymers 174 respond by changing their size and therefore, changing the distance between the drive electrode 150 and ground electrode 160. The structure 152 in the LC sensors can be shape-memory alloys, polymers, gels, ceramics or combinations thereof. The sensor may also include a membrane 182 that may be used to filter the gas 184 between inlet 176 and the structure 152.

In all of the embodiments, the housing that the sensors are enclosed in must be robust enough to withstand the high temperature, high pressure, corrosive and abrasive environments. Packaging and housing is mainly done to protect the micro-chip components from mud and other fluids in the formation, which may degrade its performance. Some materials that can be used for housing include ceramic, steel, titanium, silicon carbide, aluminum silicon carbide, Inconel®, and Pyroflask® or any material that has excellent heat conduction properties and a high Young's modulus. In order to minimize vibrations in the sensors, electronics they can be mounted and installed in ways to isolate vibrations and placed in a separate compartment within the housing. Chemical coatings can be used to further protect the micro-chip and its components from the harsh downhole environment. They can be polymeric coatings, which can be used to provide a uniform and pinhole free layer on sensor and electronic boards. These coatings can withstand continuous exposure to high temperatures for long periods of time, prevents corrosion of electrodes and is an excellent dielectric. Thermal insulation significantly extends the life and durability of the sensors and electronics. The outer protective shell shields all the components inside from the environment and can be epoxy, resin-based materials, or any material that has good thermal conductivity properties.

The sensors and instrumentation system construction should also be designed to withstand the harsh environment downhole, and therefore requires proper housing/encapsulation. The most common approach is packaging the sensors/instrumentation in ceramic or custom ceramic components. The die, where the sensors/instrumentation are fabricated on, is connected to the pins of the IC by a process known as wire bonding. The die is normally silicon (Si), which has excellent thermal conductivity, but the wires used for wire bonding, the pins and the soldering between the pins and a printed circuit board (PCB) and the glue holding the die in the packaging are susceptible to failure. To minimize failure rates gold (Au) and aluminum (Al) are used for wire bonding, high temperature alloy materials are used for soldering, and epoxies or adhesives are used to glue the sensors/instrumentation inside the package. Multi-chip modules (MCMs) such as high temperature co-fired ceramic (HTCC) and alumina boards are used to combine multiple ICs into a single system level unit. They are generally plated with Al and Au for soldering and wire-bonding and the dies on these boards are processed independently and assembled into a single device as a final step. These hybrid boards are interconnected with each other in 2D or 3D layers using ceramic single inline package headers on brazed pins (BeNi contacts). BeNi is commercially available and is a standard technology for high temperature packaging. HTCC packages have excellent mechanical rigidity, thermal dissipation and hermeticity, important features in harsh, high temperature applications. To minimize flexing MCMs a stiffening component such as a bridge over the boards or side rails is incorporated into the assembly. Silicon-on-insulator (SOI) is an alternative technology Si that can be utilized for sensors and instrumentation for harsh environments. Compared to ceramic and bulk Si technology, SOI significantly reduces leakage currents and variations in device parameters, improves carrier mobility, electro-migration between interconnects and dielectric breakdown strength. Silicon carbide (SiC) based electronics is another emerging technology but has superior properties to silicon based electronics that makes it an ideal candidate for harsh environment applications, which are thermally, mechanically and chemically aggressive. One of the advantages of the disclosed embodiments include that MEMS technology has allowed the scaling down of millimeter size devices into the micro-nano range. This provides the opportunity to package and fit sensors into smaller areas, have sensor arrays that increase the resolution of measurements, and to seamlessly integrate with other electronic components, leading to 'system on chip' devices that can be mass produced. MEMS devices have low power requirements, and the small size of the sensors makes it more tolerant to mechanical shocks and vibrations experienced in a downhole environment. At the same time, significant advancements in material science have also paved the way for materials that change shape due to their response to stimuli. This property enables them to be self-healing, self-deployable, passive sensors and actuators.

The Specification, which includes the Summary, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The systems and methods described here, therefore, are well adapted to carry out the objects and attain the ends and advantages mentioned, as well as others that may be inherent. While example embodiments of the system and method have been given for purposes of disclosure, numerous changes exist in the details of procedures for accomplishing the desired results. These and other similar modifications may readily suggest themselves to those skilled in the art, and are intended to be encompassed within the spirit of the system and method disclosed here and the scope of the appended claims.

What is claimed is:

1. A system for wirelessly sensing downhole cement sheath parameters, the system comprising:

one or more wireless mobile devices embedded in the cement sheath between a casing and a wellbore wall, the one or more wireless mobile devices comprising one or more sensors configured to sense one or more cement sheath parameters, wherein the one or more sensors further comprise:

a sensor housing with an internal space;

a ground electrode positioned within the internal space of the sensor housing;

a drive electrode located within the internal space of the sensor housing, the drive electrode moveable within the sensor housing relative to the ground electrode, where a change in distance between the ground electrode and the drive electrode results in a change of a capacitance of the one or more wireless mobile devices;

where the drive electrode is attached to a structure adapted to receive an external stimuli, the structure including a shape memory material operable to change a shape of the structure in response to the external stimuli from an unstimulated shape to a stimulated shape when the external stimuli is applied, and is operable to return to the unstimulated shape upon removal of the external stimuli, where the structure includes polymer particles having the ability to cross-link to change the shape of the structure in response to the external stimuli, where the external stimuli causes physical crosslinking of the polymer particles, resulting in an increase in size of clusters of polymer particles; and where the drive electrode is positioned a first distance from the ground electrode when the structure is in the unstimulated shape, and the drive electrode is positioned a second distance from the ground electrode when the structure is in the stimulated shape; and a reader in wireless communication with the one or more wireless mobile devices, the reader configured to receive a signal from the one or more wireless mobile devices, the signal providing information for determining the one or more sensed cement sheath parameters from the external stimuli.

2. The system according to claim 1, wherein the reader is lowered into a wellbore through a wireline or as a component of a drilling assembly.

3. The system according to claim 1, wherein the reader is lowered into the wellbore by means of a drilling fluid.

4. The system according to claim 1, wherein the reader is installed on a casing collar or a casing body.

5. The system according to claim 1, further comprising:

a plurality of wireless transmission rings wirelessly connected to the reader, the wireless transmission rings configured to receive measurement data from the receiver and transmit the measurement data to a surface computer.

6. The system according to claim 1, wherein the wireless transmission rings and the reader are connected via Wi-Fi, Wi-Fi direct, Bluetooth, Bluetooth Low Energy, or ZigBee.

7. The system according to claim 1, further comprising:

a mesh network connecting the one or more wireless mobile devices within a single well;

a wireless gateway connected to each well within a plurality of wells; and a remote server connected to the wireless gateway at each of the plurality of wells, the remote server configured to receive and store measurement data from each of the plurality of wells.

8. The system according to claim 1, wherein the one or more wireless mobile devices further comprise:

a piezoelectric crystal configured to receive an acoustic wave and convert the acoustic wave into electric energy;

a power management unit operatively connected to the piezoelectric crystal and the sensor, the power management unit configured to receive the electric energy and power the sensor;

a microcontroller operatively connected to the sensor, the microcontroller adapted to receive measurement data from the sensor and generate an output signal including the measurement data; and a modulator operatively connected to the piezoelectric crystal, the modulator adapted to receive the signal including the measurement data, and modulate the power or amplitude of the signal, wherein the piezoelectric crystal is further configured to transmit the modulated signal.

9. The system according to claim 8, wherein the one or more wireless mobile devices further comprise:

a power storage unit for storing power generated by the piezoelectric crystal.

10. The system according to claim 9, wherein the power storage unit is selected from the group consisting of a di-electric capacitor, a ceramic capacitor, an electrolytic capacitor, and a super capacitor.

11. The system according to claim 8, wherein the one or more wireless mobile devices further comprise:

a memory unit configured to store the measurement data.

12. The system according to claim 8, wherein the sensor further comprises:

a non-conductive region located between the ground electrode and the drive electrode; and an inductor in series to form a passive LC circuit.

13. The system according to claim 12, wherein the external stimuli comprises at least one of temperature, pressure, stress, strain, current, voltage, magnetic field, pH, humidity, gas, and light.

14. The system according to claim 12, wherein the shape memory material is selected from the group consisting of shape memory alloys, polymers, gels, ceramics, and combinations thereof.

15. The system according to claim 12, wherein the drive electrode and the ground electrode comprise an array of electrodes.

16. The system according to claim 12, wherein the drive electrode and the ground electrode comprise a flexible, planar, interdigital array attached to the structure.

17. The system according to claim 12, wherein the structure comprises an array of shape memory materials.

18. The system according to claim 12, wherein the housing comprises a material selected from the group consisting of ceramic, steel, titanium, silicon carbide, and aluminum silicon carbide.

19. The system according to claim 12, wherein the one or more wireless mobile devices further comprise a chemical coating to protect the wireless mobile device from harsh downhole environment, wherein the chemical coating is selected from the group consisting of epoxy, resin-based materials, and a polymeric material that has thermal conductivity properties.

20. The system according to claim 8, wherein the one or more wireless mobile devices further comprise:

a coating including a polymer or an elastomer.

* * * * *